United States Patent [19]

Cook

[11] 4,140,020

[45] Feb. 20, 1979

[54] SEAL-FREE PIPETTE DEVICE

[75] Inventor: Robert D. Cook, Los Altos, Calif.

[73] Assignee: Syva Company, Palo Alto, Calif.

[21] Appl. No.: 889,697

[22] Filed: Mar. 24, 1978

[51] Int. Cl.[2] ..... B01L 3/02

[52] U.S. Cl. ..... 73/425.6; 141/2

[58] Field of Search ..... 73/425.4 P, 425.6; 141/24, 26, 2; 417/474

[56] References Cited

U.S. PATENT DOCUMENTS

| | | | |
|---|---|---|---|
| 2,540,364 | 2/1951 | Adams | 73/425.6 |
| 2,715,331 | 8/1955 | Yates | 73/4 |

*Primary Examiner*—S. Clement Swisher

*Attorney, Agent, or Firm*—Townsend and Townsend

[57] ABSTRACT

A method and apparatus for measuring a predetermined relatively small volume of liquid from a supply liquid and subsequently dispensing that volume of liquid. A long hollow tube having one end sealed is connected at the other end to an open-ended probe. The long tube is curved into at least one C-shaped segment and is generally rigid along its entire curved length. With the probe tip inserted into the supply liquid, the curved tube is flexed about an axis normal to the plane in which it lies, thereby decreasing the cross-sectional area of the tube. Since the tube is generally rigid along its entire curved length, this flexure of the tube increases the internal volume of the tube thereby reducing the pressure within the tube and withdrawing liquid from the supply liquid into the probe. The amount of liquid withdrawn into the probe is determined by the amount of flexure of the tube. Flexure of the tube in the opposite direction causes the cross-sectional area of the tube to return to its original size thereby decreasing the internal volume of the tube and increasing the pressure within the tube which forces the liquid out of the probe.

27 Claims, 6 Drawing Figures

SEAL-FREE PIPETTE DEVICE

BACKGROUND OF THE INVENTION

This invention relates to a pipette device for measuring and dispensing a selected amount of liquid. More particularly, the invention relates to an apparatus and method for withdrawing a relatively small volume of liquid from a supply liquid by means of a pipette device which has no sliding seals or plungers. Mechanical movement of the pipette device changes the internal pressure so as to withdraw and despense the selected amount of liquid.

Conventional devices for withdrawing a predetermined volume of liquid from a supply and subsequently dispensing that volume consist primarily of either common pipettes or syringe devices. The common pipette is a hollow tube having graduated markings along its length. The tip of the common pipette is inserted into the liquid supply and the internal pressure is reduced at the opposite end of the pipette, usually by the users mouth, thereby allowing atmospheric pressure to force liquid from the supply into the pipette. The user then places his finger over the end of the pipette to create a seal. By gradually permitting air to leak into the seal between the finger and the pipette end, the level of the fluid is lowered until the meniscus reaches the desired marking on the pipette. The pipette is then placed over the container where the liquid is to be dispensed and the user removes his finger thereby allowing gravity to remove the liquid from the pipette.

Syringe devices, which generally resemble the common hypodermic syringe, also comprise a hollow tube having graduated markings along its length, but also include a sliding plunger or seal within the hollow tube. With the tip of the syringe device inserted in the supply liquid, movement of the plunger away from the tip of the syringe reduces the internal pressure and liquid is thereby withdrawn from the supply into the device. By moving the plunger downward, i.e. towards the tip, the liquid is subsequently dispensed from the syringe device.

Both the common pipette and syringe devices are inherently inaccurate, especially when measuring extremely small volumes. Over a period of extended use the seals within the syringe devices wear, thereby creating leaks and concomitant inaccuracies in the measured amount of withdrawn liquid. Further, the construction of syringe devices capable of use with extremely small volumes is difficult because of the require small size of the plunger or seal.

SUMMARY OF THE INVENTION

The present invention provides a method and seal-free pipette apparatus for withdrawing and dispensing a selected volume of liquid from a supply liquid which eliminates the problems inherent in common pipettes and syringe devices. Because there are no sliding seals or plungers, extremely small volumes of liquid may be accurately withdrawn and subsequently dispensed.

The invention comprises a long hollow tube generally rigid along its lengthwise axis and formed into a curved shape along its length. The curved tube is flexible within its elastic limit about an axis normal to the plane in which the tube lies. The tube is sealed at one end and the open end is inserted either directly into the supply liquid or connected to a probe which is inserted into the supply liquid. Flexing such a curved tube, which is preferably constructed of either metal or plastic, changes its cross-sectional area. Because the tube is substantially rigid along its entire length, the change in the cross-sectional area of the tube necessarily results in a change in its internal volume. Since one end of the tube is sealed and the open end is inserted into the supply liquid, an increase in internal volume results in a reduction in pressure within the tube, thereby allowing atmospheric pressure to force liquid from the supply into the tube. The device is calibrated so that the amount of flexure of the tube determines the amount of liquid drawn in.

The invention eliminates seals or plungers and is thus capable of accurately measuring extremely small volumes of liquid.

DESCRIPTION OF THE PREFERRED EMBODIMENTS

The present invention comprises a long thin-walled hollow tube rigid along its lengthwise axis and sealed at one end. The tube is constructed preferrably of metal or plastic, such as polyvinyl chloride, so as to be generally rigid along its lengthwise axis but flexible within the elastic limit of the material about an axis normal to the lengthwise axis. The cross-sectional configuration of the interior of the hollow tube is preferably non-circular. The tube has an open end connected to a probe having a tip for insertion into the supply liquid. When the tube is flexed about an axis normal to its length, i.e., about an axis normal to the plane in which it lies, but within the elastic limit of the material, stresses are produced within the wall of the hollow tube. The stresses are distributed around the wall of the tube and deform the cross-sectional shape thereby changing the cross-sectional area of the tube. Since the tube is generally rigid along its lengthwise axis and since no loads or forces are applied parallel to this axis, the change in cross-sectional area of the tube results in a change in internal volume of the tube. With the probe tip inserted into a supply liquid, a flexure of the tube so as to increase the cross-sectional area and thus the internal volume results in a reduction in pressure within the tube, thereby allowing atmospheric pressure to force liquid from the supply into the probe. The device is calibrated so that a specific amount of movement or flexing of the hollow tube corresponds to a specific amount of volume withdrawn into the probe.

Figure 1:
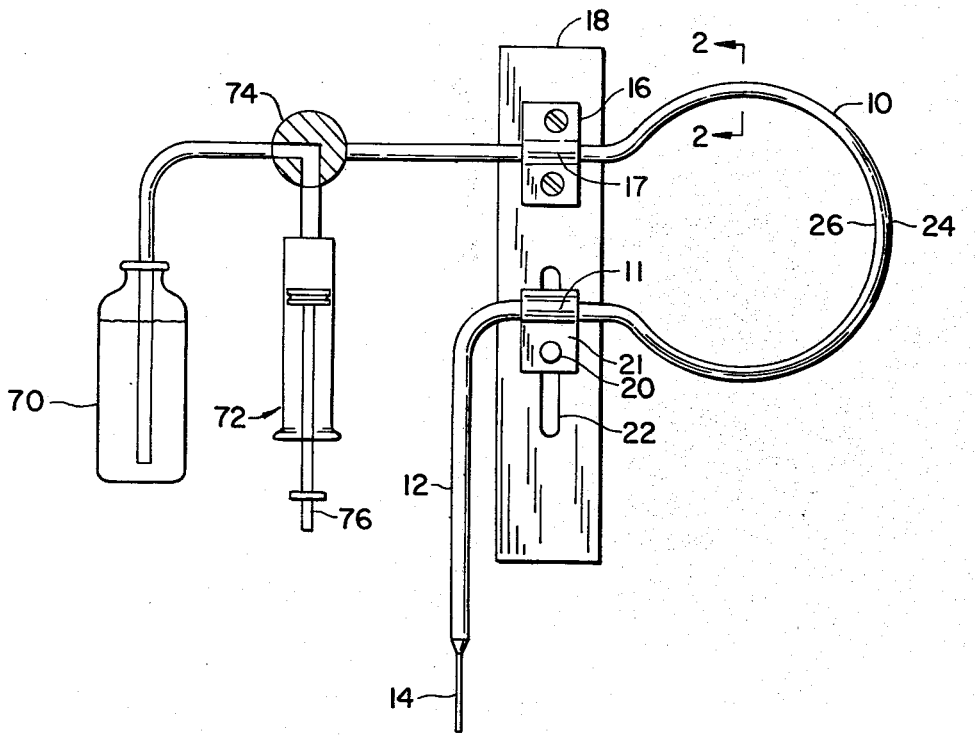
FIG. 1 illustrates an embodiment in which one end of the tube is movable and the rigidly secured end is connected to a flushing apparatus.
Figure 2:
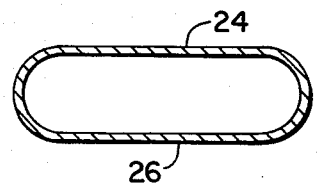
FIG. 2 is a cross-sectional view of the curved tube of FIG. 1.

The invention is illustrated in FIG. 1 and comprises generally a long hollow tube 10 connected at one end 11 to a probe 12. The probe 12 is releasably connected to the end 11 within the clamp 21, thereby permitting new probes to be easily connected to the device. The tube 10 is a long thin-walled hollow structure having an oval cross-section as shown in FIG. 2 and formed into a curved shape, for example in the C-shape as shown in FIG. 1. The tube is bent into this curved shape about an axis normal to its lengthwise axis and parallel to the major axis of the oval shaped cross-section shown in FIG. 2. The tube is preferrably constructed of a material which is rigid along its lengthwise axis, such as metal or a plastic. Such material when constructed into a thin-walled hollow tube permits the tube to be flexed about an axis normal to the plane in which the tube lies, provided the flexure imparts stresses within the elastic limit of the material. One end 17 of the tube is rigidly secured to a retaining plate 18 by a bracket 16. The other end 11 of the tube is movable relative to the fixed end. In FIG. 1, this relative motion is provided by a pin 20 which is connected to a slidable clamp 21 and which moves within a slot 22. The rigidly secured end 17 of the tube is sealed or, as shown in FIG. 1, connected to a flushing apparatus which will be more fully described below.

The tube 10 connected to the probe 12 acts to draw in fluid in a predetermined amount in the following manner. With the probe tip 14 of the probe 12 inserted into a supply liquid, the interior of the tube and probe is sealed from the outside. When it is desired to draw in liquid into the probe in a determined amount, the pin 20 is moved downward in slot 22. When the ends of the C-shaped tube are moved apart from one another by moving pin 20 and clamp 21 downward, tensile stresses are applied to the radially inner wall 26 and compressive stresses are applied to the radially outer wall 24 of the tube. These stresses caused by movement of the ends of the C-shaped tube apart from one another are thus distributed around the tube wall, resulting in a deformation of the tube cross-section. In the case where the C-shaped tube ends 11 and 17 are moved apart from one another, the stresses caused by this motion are relieved by generally increasing the distance between the parallel walls 24 and 26. The cross-section of the tube becomes somewhat more circular and accordingly, because the tube is generally rigid along its length, the internal volume of the tube is thus increased. With one end 17 sealed and the other end 11 connected to a probe 12 having a tip 14 inserted into a supply liquid, this increase in internal volume necessarily reduces the pressure within the hollow tube, thereby allowing atmospheric pressure to force liquid from the supply into the probe 12. The liquid thus withdrawn into the probe remains in the probe until the pin 20 is moved in the opposite direction so that the ends of the C-shaped tube approach one another. This motion of the ends of the C-shaped tube decreases the cross-sectional area of the tube and the internal volume of the tube. This reduction in internal volume necessarily results in an increase in pressure within the tube, which acts to expel or dispense the liquid from the probe.

The C-shaped tube shown in FIG. 1 which has the oval cross-section depicted in FIG. 2 may be constructed from a generally hollow cylindrical tube, such as hypodermic tubing, which is inserted at an angle into a pair of opposing rollers. The rollers deform the circular cross-section into a generally oval cross-section and the angular feed into the rollers results in the formation of the tube into a C-shaped curve. The resulting C-shaped tube thus essentially lies in a plane which is generally perpendicular to the largest diameter of the oval cross-section. The tube may also be constructed of glass or extruded plastic, which like metal, is generally rigid along its lengthwise axis, but flexible within elastic limits when formed or bent about an axis normal to its lengthwise axis.

Figure 3:
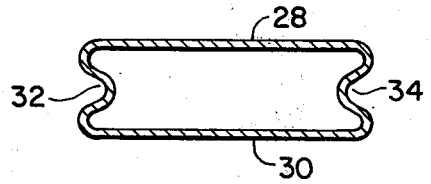
FIG. 3 is an alternative cross-sectional shape of the tube of FIG. 1.

An alternative cross-sectional configuration for the hollow tube is shown in FIG. 3. In this cross-sectional configuration, the thin wall of the tube comprises parallel sides 28 and 30 and concave ends 32 and 34. When a hollow tube having such a cross-sectional configuration is flexed or bent about an axis generally parallel to the sides 28 and 30, these sides tend to move relative to one another, which movement is facilitated by the concave shaped ends 32 and 34. Thus the ends 32 and 34 have a bellows-type action when the pin 20 is moved, thereby permitting the parallel sides 28 and 30 to move closer together or further apart, depending upon the direction of movement of pin 20. If the pin 20 were moved downward, the ends 32 and 34 would tend to move outward, thereby separating the sides 28 and 30 and increasing both the cross-sectional area and the internal volume of the tube. Similarily, if the pin 20 were moved upward, the end walls 32 and 34 would move closer together, i.e., become more concave, thereby moving the sides 28 and 30 closer together and resulting in a decrease in both the cross-sectional area and internal volume of the tube.

While the cross-sectional configurations so far discussed are non-circular it should be apparent that this non-circular configuration is selected in order to make the bending of the tube about one particular axis easier than about another axis. A tube having a circular cross-sectional configuration would be more resistant to bending than a tube having an oval cross-section which is flexed about the larger diameter of the oval.

Figure 5:
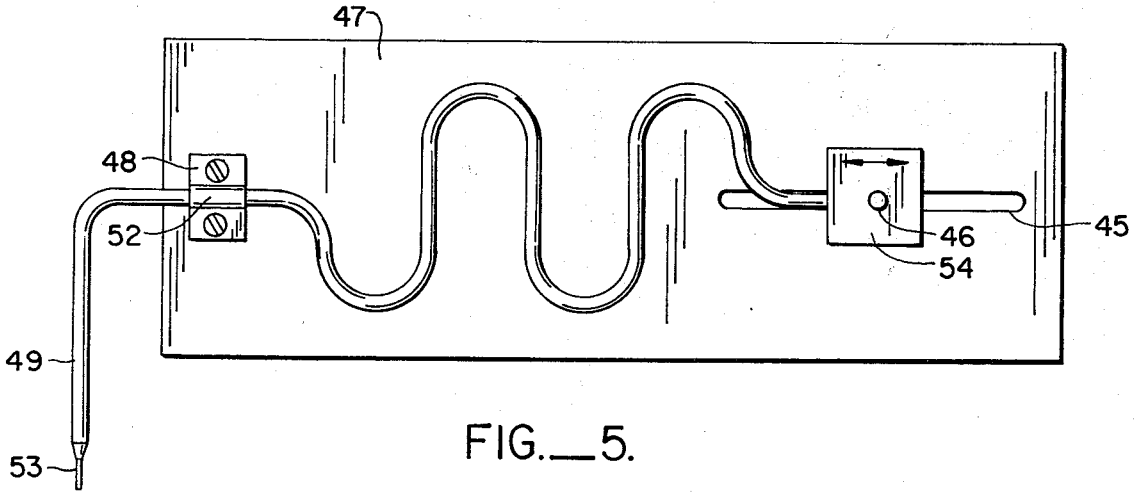
FIG. 5 illustrates an S-shaped embodiment in which the sealed end of the tube moves relative to the rigidly secured end.
Figure 4:
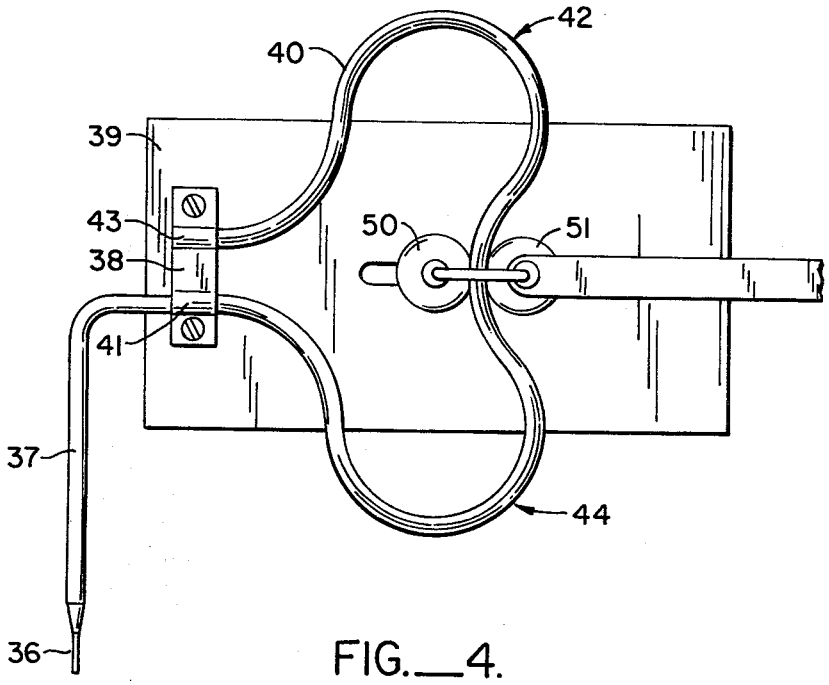
FIG. 4 illustrates an embodiment in which both ends of the curved hollow tube are rigidly secured.

The C-shaped tube illustrated in FIG. 1 is only one embodiment of numerous tube shapes which would have the same effect of reducing the internal pressure and thus drawing in liquid by mere mechanical movement of the tube. Two such embodiments are shown in FIGS. 4 and 5 and comprise in essence a series of C or U-shaped segments integrally connected to one another. The embodiment illustrated in FIG. 4 comprises a hollow tube 40 formed into two generally C-shaped segments 42 and 44. Both ends 41 and 43 of the tube are rigidly secured by bracket 38 to plate 39. The open end 41 is, like the open end in the embodiment of FIG. 1, connected to a probe 37 having a tip 36 for insertion into the supply liquid. An actuator is connected to a pair of opposing rollers 50 and 51 which straddle the tube at the section intermediate the two C-shaped segments 42 and 44. When the actuator is moved so as to move the rollers away from the fixed ends of the tube, both C-shaped segments 42 and 44 are generally enlarged, thereby increasing the internal cross-sectional area and internal volume of the tube and reducing the pressure within the tube. When the actuator is moved so that the rollers 50 and 51 move towards the secured ends 41 and 43 of the tube, the C-shaped segments are returned generally to their original shape, thereby reducing both the internal cross-sectional area and the internal volume of the tube.

Another embodiment of the present invention is illustrated in FIG. 5, and comprises a tube formed into a series of U or S-shaped segments. The end 52 of the tube is secured by a bracket 48 to a plate 47. The end 52 is open and operatively connected to a probe 49 having a tip 53. The sealed end of the S-shaped tube is connected to a clamp 54 and moves by means of a pin 46 which slides within a slot 45 on the plate 47. Movement of the pin 46 away from the secured end 52 results in an increase in the cross-sectional area and internal volume of the tube. Movement of the pin towards the secured end 53 of the tube returns the tube to its original configuration, thereby decreasing the tube cross-sectional area and the internal volume. It should be apparent that in both FIGS. 4 and 5, the preferred cross-sectional configurations of the tube are as shown either in FIGS. 2 or 3. Further, the major axis of these cross-sectional configurations are generally perpendicular to the planes defined by the C-shaped segments of FIG. 4 and the S-shaped segments of FIG. 5, thereby permitting relatively easy flexing or bending of a hollow tube without buckling and permanent deformation.

The above mentioned embodiments of the present invention involve movement of either one end of the tube or a segment of the tube in a generally linear direction relative to a rigidly secured end of the tube. The internal pressure may be reduced within the hollow tube by mechanical movement of one end of the tube in the manner shown in the embodiment of FIG. 6. The embodiment of FIG. 6 comprises generally a spiral-shaped tube having an open end 55 rigidly secured to a plate 63 and operatively connected to a probe 62. The sealed end 58 of the spiral-shaped tube is at the inner most point of the spiral curve and operatively connected to a rotatable knob 57. This spiral-shaped tube also has a cross-sectional configuration as shown either in FIG. 2 or 3. The spiral-shaped tube generally lies in a plane which is normal to the major axis of the oval shaped cross-section of FIG. 2, or to the parallel sides 28 and 30 of the cross-sectional configuration shown in FIG. 3. With the probe tip 60 of the probe 62 inserted into the supply liquid, the knob 57 connected to the sealed end of the spiral shaped tube is rotated in a counterclockwise direction so as to "unwind" or expand the spiral shape into a spiral having a greater outer diameter. Rotation of the sealed end in a counterclockwise direction results in compressive stresses on the outer wall 64 and tensile stresses on the inner wall 66 of the spiral shaped tube. These stresses tend to change the cross-sectional configuration of the spiral shaped tube into a more circular configuration, thereby increasing the tube internal volume. Rotation of the knob 57 in a clockwise direction returns the tube cross-sectional configuration to its original shape, thereby decreasing the tube internal volume.

While all the embodiments as thus shown and described depict the curved tube as lying essentially in a plane, the invention may also comprise a three dimensional tube, as for example a tube having a helical configuration. Thus any motion or flexure of such a three-dimensional configured tube which alters the shape of the three-dimensional curve defined by the tube would result in a change in cross-sectional area and internal volume.

Figure 6:
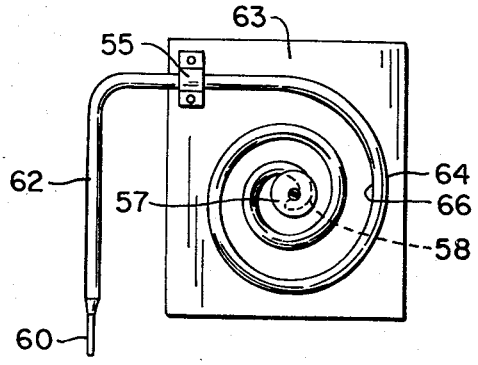
FIG. 6 illustrates a spiral-shaped embodiment in which the sealed end is rotatable.

It should be apparent that by calibrating either the linear or rotary motion of the actuators, i.e. the pin in FIGS. 1 and 5, the rollers in FIG. 4, or the knob in FIG. 6, any pre-selected amount of liquid may be withdrawn from the supply into the probe.

Furthermore, the probe itself may be calibrated in the manner common pipettes are calibrated, namely by graduated markings on the wall of the glass probe. Since the present invention does not require movable plungers or seals within the hollow tube to create a vacuum, but instead relies on the generally small mechanical flexure of the thin-walled hollow tube, extremely small volumes of liquid, generally less than 100 microliters, may be accurately measured from a supply and subsequently dispensed.

Referring now again to FIG. 1, the invention may be utilized with a flushing device comprising essentially a reservoir 70 containing a flushing substance or diluent, a syringe 72, and a rotary valve 74 interconnecting the reservoir 70, the syringe 72 and an end 17 of the C-shaped tube. When it is desired to draw in a selected amount of liquid from the supply into the probe, the rotary valve is in the position shown in FIG. 1, thereby effectively sealing end 17 of the tube. After the liquid has been withdrawn into the probe and subsequently dispensed in the manner as above described, the plunger 76 of the syringe is withdrawn to pull diluent into the syringe. The rotary valve is then rotated counterclockwise 90° so as to interconnect the syringe with the open end 17 of the tube. The plunger 76 is then pushed forward to introduce the diluent under pressure into the tube 10 and probe 12 for flushing any remaining liquid completely out of the probe. The diluent which remains in the tube and probe may be withdrawn back into the syringe 72 for subsequent transfer back to the reservoir 70 by withdrawing the plunger 76. Alternatively, an air inlet could be provided in the valve. The plunger 76 would then force air through the tube and probe to expel the remaining diluent.

While the preferred embodiment of the present invention have been illustrated in detail, it is apparent that modification and adaptation of those embodiments will occur to those skilled in the art. However, it is to be expressly understood that such modifications and adaptations are within the scope of the present invention as set forth in the following claims.

What is claimed is:

1. A method for measuring and dispensing a predetermined amount of liquid from a supply liquid into a pipette comprising a generally long hollow tube whose length defines a curve, said tube being flexible so as to permit the shape of said curve to be changed, said tube further being generally rigid along its length so that the overall length of said tube remains relatively constant as the shape of said curve changes, wherein one end of the tube is sealed and an open end of the tube is operatively connected to said supply liquid, the method comprising the steps of:

flexing said tube so as to change the shape of said curve whereby the internal cross-sectional area and internal volume of said tube is increased, thereby withdrawing liquid into said pipette;

stopping the flexure of said tube when a predetermined amount of liquid has been withdrawn into said pipette; and restoring said flexed tube to generally its shape prior to flexing, whereby at least a portion of said withdrawn liquid is thereby dispensed.

2. A method according to claim 1 wherein said tube has generally a C-shape and a generally oval cross section and wherein the step of flexing said tube includes the step of moving said tube about an axis generally parallel to the major diameter of said oval cross section.

3. A method according to claim 2 wherein one end of said C-shaped tube is rigidly secured and wherein the step of moving comprises the steps of:

moving the other end of said C-shaped tube relative to said rigidly secured end so as to increase the distance between the ends of said tube.

4. A method according to claim 1 wherein said tube has a generally oval cross section and wherein the length of said tube defines a generally spiral curve lying in a plane generally perpendicular to the major diameter of said oval cross section, the open end of said tube being rigidly secured and the sealed end of said tube being at the innermost point of said spiral, and wherein the step of flexing includes the step of rotating the sealed end of said spiral shaped tube about an axis generally parallel to the major diameter of the oval cross section of said tube so as to generally enlarge the spiral shape of said tube.

5. A method according to claim 1 wherein said tube has a generally oval cross section, the length of said tube defining a generally S-shaped curve, and wherein the step of flexing includes the step of moving the ends of said S-shaped tube generally apart from one another, thereby increasing the volume within said tube and withdrawing liquid into said pipette.

6. A method for withdrawing a small volume of liquid into a pipette, for subsequently dispensing that liquid and for cleansing said pipette for reuse after the liquid has been expelled from the pipette, wherein the pipette comprises a probe for insertion into the liquid supply and a generally C-shaped hollow tube having a generally oval cross section wherein the major diameter of said cross section is generally normal to the plane defined by said C-shaped tube and wherein a first end of the tube is generally immovable, the other end of the tube being operably connected to the probe, the method comprising the steps of:

moving said other end of said tube generally away from said first end thereby increasing the cross sectional area and internal volume of said tube and withdrawing liquid from the liquid supply into said probe;

stopping the movement of the other end of said tube when a predetermined amount of liquid is withdrawn into said probe;

moving the other end of said tube generally towards said first end thereby decreasing the cross sectional area and the internal volume of said tube whereby the predetermined amount of liquid in said probe is expelled; and introducing under pressure into said first end a diluent for flushing said probe.

7. An apparatus for withdrawing a predetermined amount of liquid from a supply of liquid and for accurately dispensing the withdrawn liquid which comprises:

a generally long thin-walled hollow tube having an open end operatively connected to the supply, said tube being generally rigid along its lengthwise axis; and means operatively connected to said tube for flexing said tube about an axis normal to its lengthwise axis whereby the cross sectional area and the internal volume of said tube is increased for withdrawing liquid from the supply into the open end of said tube.

8. Apparatus according to claim 7 including means operatively connected with the open end of said tube for retaining the liquid withdrawn from the liquid supply.

9. Apparatus according to claim 8 wherein said retaining means further comprises a hollow probe having one end for insertion into the liquid supply and an opposite end operatively connected to the open end of said tube.

10. Apparatus according to claim 9 wherein said probe is removably connected to said tube.

11. Apparatus according to claim 7 wherein said tube has a generally oval shaped cross section and is formed along its lengthwise axis into at least one generally C-shaped curve, the plane defined by said C-shaped curve being generally perpendicular to the major diameter of the oval cross section of said tube.

12. Apparatus according to claim 11 wherein said flexing means includes means for moving the ends of said tube relative to one another.

13. Apparatus according to claim 11 wherein one end of said tube is rigidly secured and wherein said flexing means includes means for moving the other end of said tube relative to said rigidly secured end.

14. Apparatus according to claim 11 wherein said tube is formed into two interconnected C-shaped segments, said tube having ends rigidly secured so as to prevent movement of said tube ends relative to one another, and wherein said flexing means further comprises means for moving said interconnected segments relative to said rigidly secured tube ends.

15. Apparatus according to claim 7 wherein said tube has a generally S-shaped configuration along its lengthwise axis, one end of said tube being rigidly secured, and wherein said flexing means further comprises means for moving the other end of said S-shaped tube relative to said rigidly secured end.

16. Apparatus according to claim 7 including means operatively connected to the other end of said tube for introducing a diluent into said tube for flushing said tube of liquid.

17. Apparatus according to claim 7 wherein said tube has a generally spiral shape along its lengthwise axis and wherein the open end of said spiral shaped tube is rigidly secured and is located radially outward of the other end of said tube.

18. Apparatus according to claim 17 wherein said flexing means further comprises means at said other end of said spiral shaped tube for rotating said other end about an axis generally normal to the plane defined by said spiral shaped tube.

19. Apparatus according to claim 18 including means operatively connected with the open end of said spiral shaped tube for retaining the liquid withdrawn from the supply.

20. Apparatus according to claim 17 wherein said spiral shaped tube has a generally oval shaped cross section and wherein the major diameter of said oval shaped cross section is generally perpendicular to the plane defined by said spiral shaped tube.

21. Apparatus according to claim 7 wherein the wall of said hollow tube comprises two generally parallel sides and means operatively connecting said sides to one another for permitting said sides to move relative to one another.

22. Apparatus according to claim 7 wherein said long hollow tube has an outer wall shaped so as to form two generally flat parallel sides and two generally concave shaped ends connecting said sides to one another, whereby said concave ends permit movement of said sides relative to one another when said tube is flexed about an axis normal to its lengthwise axis, thereby varying the cross sectional area and internal volume of said tube.

23. An apparatus for measuring a predetermined amount of liquid from a supply liquid and for subsequently dispensing that amount of liquid, the apparatus comprising:

a thin-walled hollow tube having a generally oval cross section and formed about an axis generally parallel to the major diameter of said oval cross section into a C-shape;

a probe having one end for insertion into the supply liquid and an opposite end operatively connected to a first end of said tube;

means for moving one end of said tube relative to the other end of said tube so as to vary the cross sectional area and the internal volume of said tube whereby a predetermined amount of liquid is withdrawn from the supply into said probe; and means for introducing into the second end of said tube a diluent for flushing said tube and said probe after the liquid has been dispensed from said probe.

24. Apparatus according to claim 23 wherein said tube is constructed of metal.

25. Apparatus according to claim 23 wherein said tube is constructed of plastic.

26. Apparatus according to claim 23 wherein said tube is constructed of glass.

27. Apparatus according to claim 23 wherein said introducing means further comprises:

a reservoir for storing a supply of diluent;

a syringe for withdrawing the diluent from said reservoir and for subsequently introducing said diluent under pressure into said tube; and valve means operatively interconnecting said reservoir, said syringe and said second end of said tube to one another.

* * * * *